US005676327A

United States Patent [19]

Wittrisch

[11] Patent Number: 5,676,327

[45] Date of Patent: Oct. 14, 1997

[54] DEVICE FOR STORING AND FOR HANDLING A ROD MADE OF COMPOSITE

[75] Inventor: Christian Wittrisch, Rueil Malmaison, France

[73] Assignee: Institut Francais Du Petrole, Rueil Malmaison, France

[21] Appl. No.: 552,119

[22] Filed: Nov. 2, 1995

[30] Foreign Application Priority Data

Nov. 2, 1994 [FR] France ..... 94 13164

[51] Int. Cl.[6] ..... B65H 75/38

[52] U.S. Cl. ..... 242/390.3; 242/397.5

[58] Field of Search ..... 242/390.3, 397.2, 242/397.3, 397.5, 396.6, 156.1, 157 R; 254/333

[56] References Cited

U.S. PATENT DOCUMENTS

| | | | |
|---|---|---|---|
| 1,761,593 | 6/1930 | Seidel | 242/397.5 |
| 2,049,086 | 7/1936 | Shingleton | 242/397.5 |
| 2,625,373 | 1/1953 | Hunt | 242/397.5 |
| 2,976,017 | 3/1961 | Le Bus | 254/333 |
| 3,042,375 | 7/1962 | Fahey et al. | 254/333 |
| 3,313,346 | 4/1967 | Cross | 166/5 |
| 3,401,749 | 9/1968 | Daniel | 166/46 |
| 3,872,680 | 3/1975 | Nicholson et al. | 242/397.5 |
| 4,066,093 | 1/1978 | Egerstrom | 242/390.3 |
| 4,581,497 | 4/1986 | Morrison et al. | 242/397.5 |
| 4,616,791 | 10/1986 | Harvey | 242/397.2 |
| 4,789,108 | 12/1988 | Recalde | 242/397.2 |

FOREIGN PATENT DOCUMENTS 2 182 637 5/1987 United Kingdom .

*Primary Examiner*—John M. Jillions

*Attorney, Agent, or Firm*—Millen, White, Zelano, & Branigan, P.C.

[57] ABSTRACT

A device for storing and for handling an elastically flexible and compression resistant rod. The device includes a reel on which is wound the rod in an elastic state, and rollers for holding the rod pressed on the barrel of the reel. The device also comprises wheels for shifting the rod, said means being located in the neighborhood of the reel and close to the mouth of a pipe into which the rod is run.

14 Claims, 2 Drawing Sheets

DEVICE FOR STORING AND FOR HANDLING A ROD MADE OF COMPOSITE

BACKGROUND OF THE INVENTION

The present invention relates to a device for handling an elastically flexible and compression resistant elongated element, for example a rod made of composite comprising reinforcing fibers embedded in a thermoplastic or a thermosetting resin. Such a rod is described in document U.S. Pat. No. 5,184,682.

Considering the nature of the manufacturing materials, a rod made of composite is preferably wound on storage or handling means so that the stresses due to winding or unwinding deformations are at most equal to the yield limit of the composite. As a result, such a rod elastically wound on a cylindrical support does not remain stable on the support but reacts as a spring when one of its ends is free or when the rotation of the support is not controlled.

A preferred application of an elastically flexible and compression resistant rod is to be able to push and to pull devices, for example measuring devices, in pipes such as pipelines, drain holes, wells, lines, etc. In order to run such a rod safely, it is preferable to use handling means specific to the elastic nature of the rod and to the fact that the rod has to be pushed, pulled and stored elastically on a relatively compact support.

SUMMARY OF THE INVENTION

The present invention thus relates to a device for handling an elastically flexible and compression resistant rod made of composite, the device including a reel on which said rod is wound in an elastic state. The reel comprises means for holding the rod pressed against the barrel of the reel and means for rotating said reel.

The holding means can comprise rollers whose axis is parallel to the axis of the reel, and means for applying said rollers onto said rod wound on the barrel of the reel.

The rollers can be mounted on slides arranged radially with respect to the axis of the reel, so that said rollers move radially as a function of the number of layers of rod wound on the reel.

The application means can comprise springs fastened to said rollers.

The application means can comprise hydraulic or pneumatic jacks.

The device can comprise means for shifting the rod, the means being located in the neighbourhood of the reel and close to the mouth of a pipe into which the rod is run.

The means for rotating the reel can comprise means for co-operating with the shifting means so as to wind the rod on the reel when it is shifted out of the pipe, and to unwind the rod when it is shifted towards the bottom of the pipe.

The rod can include at least one electric line over the total length thereof, and the device can comprise an electric rotary joint placed on the shaft of the reel, the line at the end of the rod on the reel side being connected to the rotary joint, the other end being connected to a measuring instrument fastened to the rod.

The device can comprise means for guiding the winding of the rod on the reel in contiguous coils.

BRIEF DESCRIPTION OF THE DRAWINGS

Other features and advantages of the invention will be clear from reading the description hereafter given by way of non limitative examples, with reference to the accompanying drawings in which.

DESCRIPTION OF THE PREFERRED EMBODIMENTS

Figure 1:
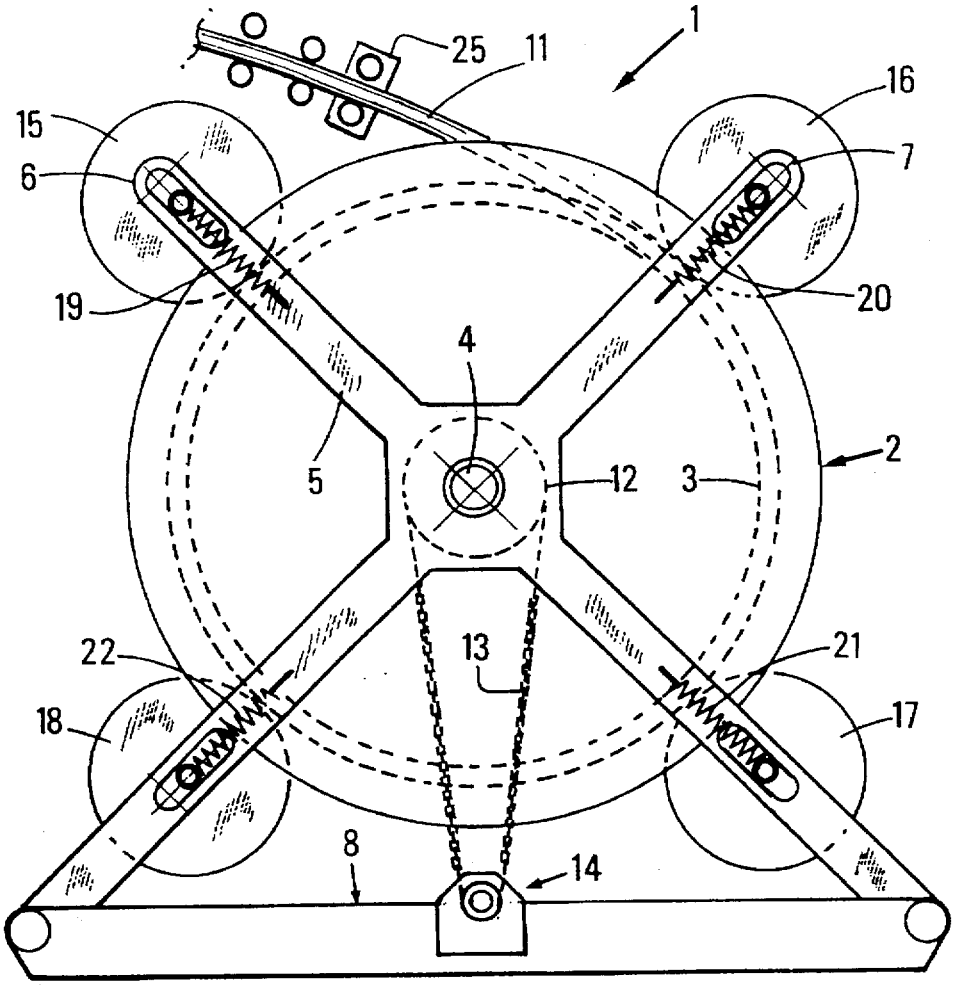
FIG. 1 shows a reel according to the invention.

FIG. 1 is a side view of a reel 1 consisting of a drum 2 whose shaft 4 is fastened to a frame 5 by means of bearings. Frame 5 comprises, on each side of the drum, two girders 6 and 7 integral with a sole piece 8. Drum 2 has a conventional shape and comprises a barrel 3 framed by two wings 9 and 10 delimiting the volume in which the rod 11 is stored.

The present device is suited to all elongated elements, such as rods or tubes, that can be wound on a reel in an elastic state. This is notably the case of elongated elements made of plastic with or without reinforcing fibers embedded in cross-linkable resin. The invention is preferably suited to a rod such as that described in document U.S. Pat. No. 5,184,682.

A pinion 12 for driving the reel into rotation by means of a transmission chain 13 and motorization means 14 is fastened to the shaft 4. These motorization means are hydraulic, pneumatic or electric, preferably with a variable speed and a double sense of rotation. Furthermore, the motorization means preferably comprise a system for slowing down the rotation of the drum when the latter possibly becomes motive.

Girders 6 and 7 and their symmetrical parts on the other face of the drum bear four rollers 15, 16, 17 and 18.

Figure 2A:
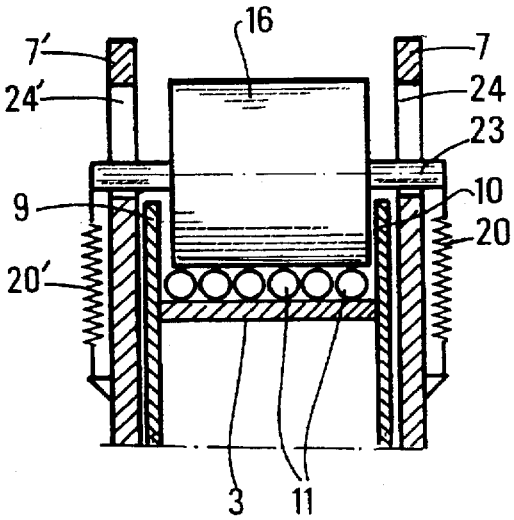
FIGS. 2A and 2B show a partial cross-section of a preferred example of the holding means, FIG. 3 schematizes a preferred application of the device, and FIG. 4 schematizes another application.
Figure 2B:
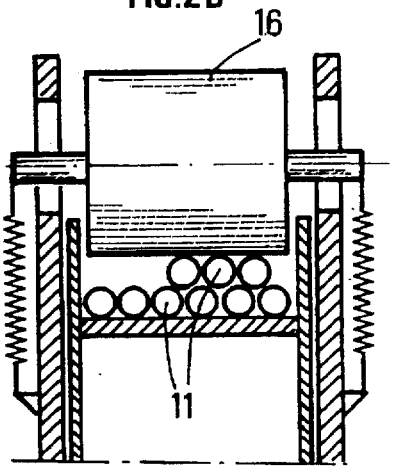

The structure of each roller 15, 16, 17 and 18 is shown in detail in FIGS. 2A and 2B, as well as their fitting on frame 5.

The four rollers are pressed on the barrel of the drum or on the rod layers wound on the drum by application means, for example tension springs 19, 20, 21 and 22. These springs, fastened to the frame on one side and to the shaft of each roller on the other side, can be replaced by any other equivalent system, a hydraulic or a pneumatic pull or push jack.

FIGS. 2A and 2B illustrate the function of the rollers, for example roller 16 whose shaft 23 has such a length that it crosses girder 7 and its symmetrical part 7' through ports 24 and 24'. These ports 24 and 24' of elongated shape act as slides for shaft 23 so that roller 16 can move close to or away from barrel 3.

Shaft 23 is assembled on roller 16 by means of bearings so that the roller can freely roll on the barrel or on the layers of rod 11. All the other rollers are of equal construction. The invention is not limited to four rollers, in some cases other rollers will be necessary, whereas for more flexible rods, only one or two rollers would be necessary.

In FIG. 2A, roller 16 is pressed against a layer of rod 11 wound on barrel 3.

In FIG. 2B, an additional length of rod 11 has been wound on the reel and forms a second layer. The holding roller has moved between flanks 9 and 10 in order to hold up the rod by means of the upper layer, by making use of the possibility of radial displacement of the roller provided by springs 20 and 20'.

Another embodiment may comprises a support instead shaft 23, said support being adapted to slide radially as the shaft 23. This support comprises a roller of a smaller diameter than roller 16 (FIGS. 2A and 2B) which diameter is in relation with the height of the flanks 9, 10. The roller may go down toward the barrel 3 because of the displacement of its support. So the diameter of the roller may be smaller and independent of the flanks 9, 10.

In case of break of the rod, the coils wound on the reel cannot slacken because they are kept in position by the rollers or equivalent parts.

In FIG. 1, reference number 25 refers to a guide for rod 11, that is connected to the frame by a transverse slide (not shown). The slide allows guide 25 to move as a function of the number of coils. This winding guidance operation, referred to as spooling, can be performed manually, i.e. the operator shifts the guide according to the way he sees the rod wind, or automatically as a function of the number of turns around the reel, knowing that for one turn, the guide must move by one width of the rod. The automatic spooling means are well-known and can be made up of gears and/or a helical inverted double-thread screw.

Figure 3:
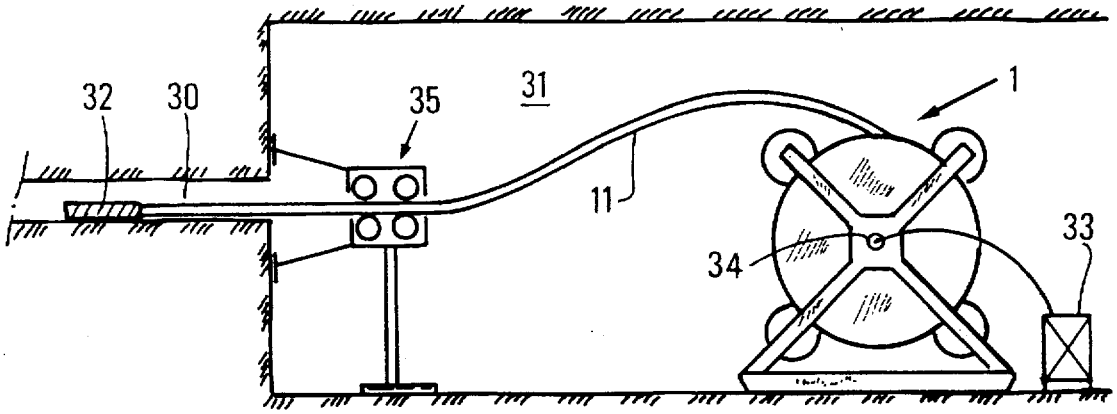

FIG. 3 shows an application of the device to measurements in a hole 30 drilled from a gallery 31. Rod 11 preferably comprises a data transmission line, for example an electric line. A measuring device 32 is fastened to the end of the rod and transmits the measurements to acquisition means 33 by means of the transmission line. The transmission line, on the side where the end of the rod is fastened to the drum of reel 1, is connected to means 33 by a rotary joint 34 placed in line with the shaft of the drum. Such a rotary joint is not described here since its conventional construction is well-known.

Means 35 for shifting rod 11 are placed close to the mouth of hole 30 so that the measuring equipment 32 can be easily moved in hole 30, by pushing or by pulling the rod. At the same time, reel 1 unwinds the length of rod 11 corresponding to the length entering the hole, or winds the length of rod when means 35 move it out of the hole. The means for rotating the reel and shifting means 35 must co-operate so that the rod portion between the reel and the shifting means is sufficiently tight and that rod 11 is not likely to break. In a simplified way, the reel can be only slightly slowed down when the shifting means 35 drive the rod into the hole and consequently pull at the rod wound on the reel. In this case, for removing the rod, the motorization of the reel can pull the rod while winding it on the drum, the shifting means are then disengaged or even totally withdrawn from rod 11.

The shifting means 35 consist for example of a set of two pairs of wheels, each pair being pressed against the rod, in an opposite way. At least one pair of wheels is mechanically connected to a motorization. Through the friction produced by the clamping of the wheels on the rod, the driving wheels drive rod 11 longitudinally. The clamping surface can be increased by using a continuous band or chain driven by pinions and clamped on the rod by an array of pressing rollers.

Figure 4:
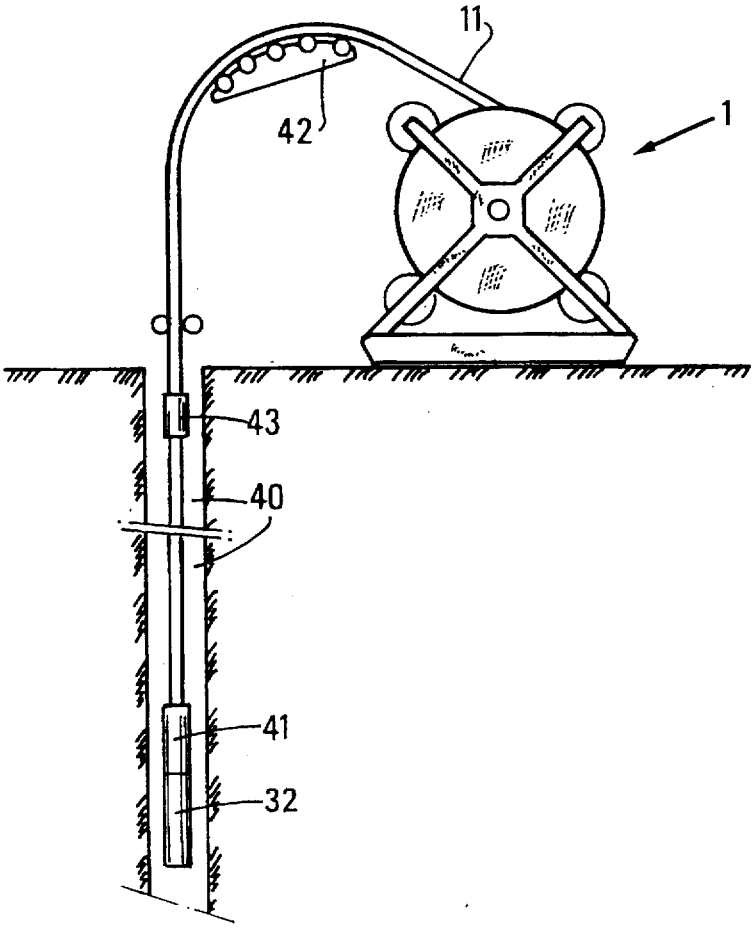

FIG. 4 is another application variant of the device according to the invention. This variant is more particularly suited to wells starting vertically.

A substantially vertical well 40 is drilled from the surface of the ground where a reel 1 for storing a rod 11 is located.

As in the previous application, a device 32 such as a measuring device for example is fastened to the end of rod 11.

In order to facilitate the lowering of device 32 at the end of rod 11, it is possible to fasten operating means 41, for example weighting bars for increasing the force of gravity in the vertical or subvertical part of the well, or seal cups in well 40 that can help to lower device 32 by pumping a fluid in well 40. To carry out this pumping operation, the head of well 40 must first be provided with seal and pumping means.

In this application, rod 11 is guided by a set of rollers 42 to the mouth of well 40. In order to lower device 32, rod 11 is unwound by rotating the reel, the weight of the device, possibly weighting bars 41, being sufficient for pulling the assembly consisting of rod 11 and measuring device 32 towards the bottom of the well.

If well 40 has an inclined part, even close to the horizontal, weights 43 can be assembled, from the surface, around rod 11 so that these weights push the lower rod portion and help device 32 to enter the deflected well portion.

Device 32 is shifted towards the surface by rotating reel 1 in the direction of the winding of the rod.

I claim:

1. A reel for coiling around the axis thereof and dispensing therefrom an elastically flexible and compression-resistant rod, the reel comprising:

a barrel portion around which the rod is coiled;

a pair of opposed flanges, each extending radially beyond the barrel for providing a groove into which the coiled rod is nested;

pairs of opposed struts extending radially from the axis of the reel, each pair of struts having opposed end portions extending in opposite directions beyond the peripheries of the flanges; and a roller supported between the opposed end portions of each pair of struts and engaging the coiled rod, the rollers being biased radially inward toward the axis to retain the rod coiled around the barrel and within the flanges.

2. The reel of claim 1, further including a base and a connection between at least one of the struts and the base for supporting the reel in spaced relation to the base.

3. The reel of claim 2, wherein there are two pairs of struts oriented at 90° with respect to one another.

4. The reel of claim 3, wherein the reel is driven by a rotating drive shaft mounted on the base connected by a chain or belt to a hub on the reel.

5. The reel of claim 2 further including a guide associated therewith disposed between two rollers proximate the top of the reel.

6. The reel of claim 1 further including a measuring device connected to the rod at the axis of the reel.

7. A device as claimed in claim 1, further comprising; and means (35) for shifting the rod, said means being arranged in the neighbourhood of the reel and close to the mouth of a pipe in which the rod is run.

8. A device as claimed in claim 7, wherein said means for rotating the reel comprises means for co-operating with said shifting means so as to wind the rod on the reel when the rod is shifted out of the pipe, and to unwind the rod when it is shifted towards the bottom of the pipe.

9. A device as claimed in claim 1, wherein, said rod comprises at least one electric line over its total length, and in that said reel comprises an electric rotary joint (34) placed on the shaft of the reel, said line at the end of the rod on the reel side being connected to said rotary joint, the other end being connected to a measuring instrument (32) fastened to the rod.

10. A device as claimed in claim 1, further comprising means (25) for guiding the winding of the rod on the reel in contiguous coils.

11. A device as claimed in claim 1, wherein said rollers are mounted on slides (24, 24') placed radially with respect to the axis of the reel, so that said rollers move radially as a function of the number of layers of rod wound on the reel.

12. A device as claimed in claim 7, wherein said rollers are mounted on slides (24, 24') placed radially with respect to the axis of the reel, so that said rollers move radially as a function of the number of layers of rod wound on the reel.

13. A device as claimed in claim 12, wherein said means for rotating the reel comprises means for co-operating with said shifting means so as to wind the rod on the reel when the rod is shifted out of the pipe, and to unwind the rod when it is shifted toward the bottom of the pipe.

14. A device as claimed in claim 13, wherein said rod comprises at least one electric line over its total length, and in that said reel comprises an electric rotary joint (34) placed on the shaft of the reel, said line at the end of the rod on the reel side being connected to said rotary joint, the other end being connected to a measuring instrument (32) fastened at the rod.

* * * * *